United States Patent [19]

Hunsberger et al.

[11] 4,305,336

[45] Dec. 15, 1981

[54] RETRACTABLE DERAILMENT GUARD SUSPENSION

[76] Inventors: John C. Hunsberger, 116 Candlelight Dr., McMurray, Pa. 15317; Buddy J. Payton, R.D. #2, Box 714, Eighty Four, Pa. 15330

[21] Appl. No.: 113,974

[22] Filed: Jan. 21, 1980

[51] Int. Cl.[3] ..... B61B 12/02; B61F 9/00; B61F 11/00; B61F 13/00

[52] U.S. Cl. ..... 105/215 R; 104/247; 105/217

[58] Field of Search ..... 104/245, 246, 247; 105/215 C, 215 R, 216, 217

[56] References Cited

U.S. PATENT DOCUMENTS

| | | | |
|---|---|---|---|
| 146,685 | 1/1874 | Jones et al. | 104/247 X |
| 197,945 | 12/1887 | Reble | 104/246 |
| 350,263 | 10/1886 | Menzies | 104/245 |
| 655,465 | 8/1900 | Stuebner | 104/245 X |
| 1,070,248 | 8/1913 | Haldeman | 104/245 X |
| 1,341,249 | 5/1920 | Widegren | 104/247 X |
| 1,373,754 | 4/1921 | Miller | 104/246 |
| 1,422,021 | 7/1922 | Zeis | 104/246 |
| 1,562,036 | 11/1925 | Miller | 104/247 X |
| 1,825,468 | 9/1931 | Miller | 104/247 |
| 1,829,358 | 10/1931 | Kintner | 104/247 |
| 2,503,120 | 4/1950 | Meyer | 104/247 |
| 2,986,102 | 5/1961 | Cox | 105/215 C |
| 3,050,016 | 8/1962 | Fischer | 105/215 R X |
| 3,130,686 | 4/1964 | Fiechter et al. | 105/215 C |
| 3,182,513 | 5/1965 | Mülhaupt | 104/245 X |
| 3,311,067 | 3/1967 | Gretzschel et al. | 105/216 X |
| 3,412,690 | 11/1968 | Broggie et al. | 104/245 X |
| 3,580,183 | 5/1971 | Nearman | 104/245 X |
| 3,645,211 | 2/1972 | Gretzschel et al. | 105/216 X |
| 3,648,617 | 3/1972 | Metzner et al. | 104/245 X |
| 3,673,966 | 7/1972 | Wilson | 104/245 X |
| 3,812,789 | 5/1974 | Nelson | 104/245 X |
| 3,831,527 | 8/1974 | Peterson | 105/215 R X |
| 4,068,598 | 1/1978 | Bardet | 104/245 X |

*Primary Examiner*—Joseph F. Peters, Jr.
*Assistant Examiner*—Howard Beltran
*Attorney, Agent, or Firm*—Buell, Blenko, Ziesenheim & Beck

[57] ABSTRACT

A derail guard to prevent derailment of railed vehicles which can be readily attached to existing equipment is disclosed. The derail guard is particularly useful for track construction and repair equipment.

4 Claims, 2 Drawing Figures

RETRACTABLE DERAILMENT GUARD SUSPENSION

This invention relates to derail guards for rail vehicles which will prevent the vehicle from derailing when it encounters broken or uneven track. The derail guards when used on track construction equipment will keep the equipment in alignment when replacing or installing railroad track.

Oftentimes in railroad track construction the track crew will encounter situations where only one rail is present and a second rail must be installed. By attaching the derail guards of our invention to the track construction equipment this single rail can be used to keep the equipment in line.

Our invention can also be used on rolling stock to prevent derailment on broken or uneven track. In preventing derailment the substantial delays, cargo damage, and equipment damage which usually accompany a derailment can be avoided.

Erosion of the roadbed and weathering of the track often result in breakage or movement of railroad track over time. When rolling stock or track repair equipment encounters broken or uneven track, derailment often occurs. Once derailment occurs substantial delays and damage to the cargo or equipment being transported are the usual result.

Numerous systems have evolved in the art to prevent derailment. Track designs having cavities adapted to receive unique wheel configurations have been proposed. Dual wheel systems have been suggested. Rocking assemblies attached to the vehicle or axle have been disclosed. Many of these units are impractical because they cannot be used for vehicles traveling on standard railroad tracks. Others must be built into the vehicle and are not readily removable when not needed.

Our invention overcomes these and other defects by providing a derail unit that can be readily connected to existing railroad equipment. The unit is designed so it can be retracted when not needed. It is small enough that it can be readily transferred from one vehicle to another.

We provide a derail guard which consists of a leg pivotably attached to a base which is designed for attachment to the vehicle. Rollers are provided at the foot of the leg which ride behind the vehicle wheel against the side of the track when the unit is in an operable position. The pivotable attachment allows the leg to be retracted when the derail guard is not needed. Locking means are provided to keep the leg in operable or rest position as desired.

The pivotable feature of the device is particularly useful for track construction equipment. When the equipment is being transported over undamaged track, as from one job site to another, the derail guard can be retracted thereby reducing wear on the rollers. Upon reaching the damaged track the derail guard can be extended thereby enabling safe travel over uneven or broken track.

Other details, objects and advantages of the invention will become apparent as the following description of a present preferred embodiment thereof proceeds.

In the accompanying drawings we have shown a present preferred embodiment of the invention in which.

Figure 1:
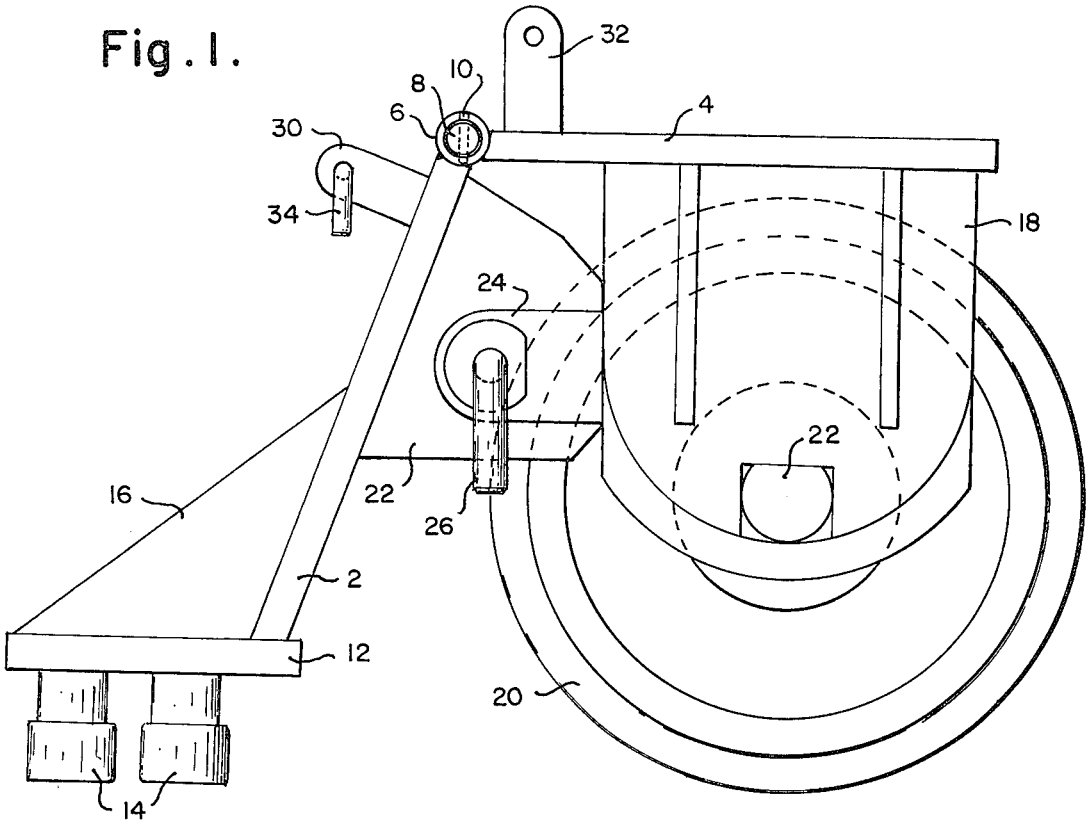
FIG. 1 is a side view of the preferred embodiment of the invention.
Figure 2:
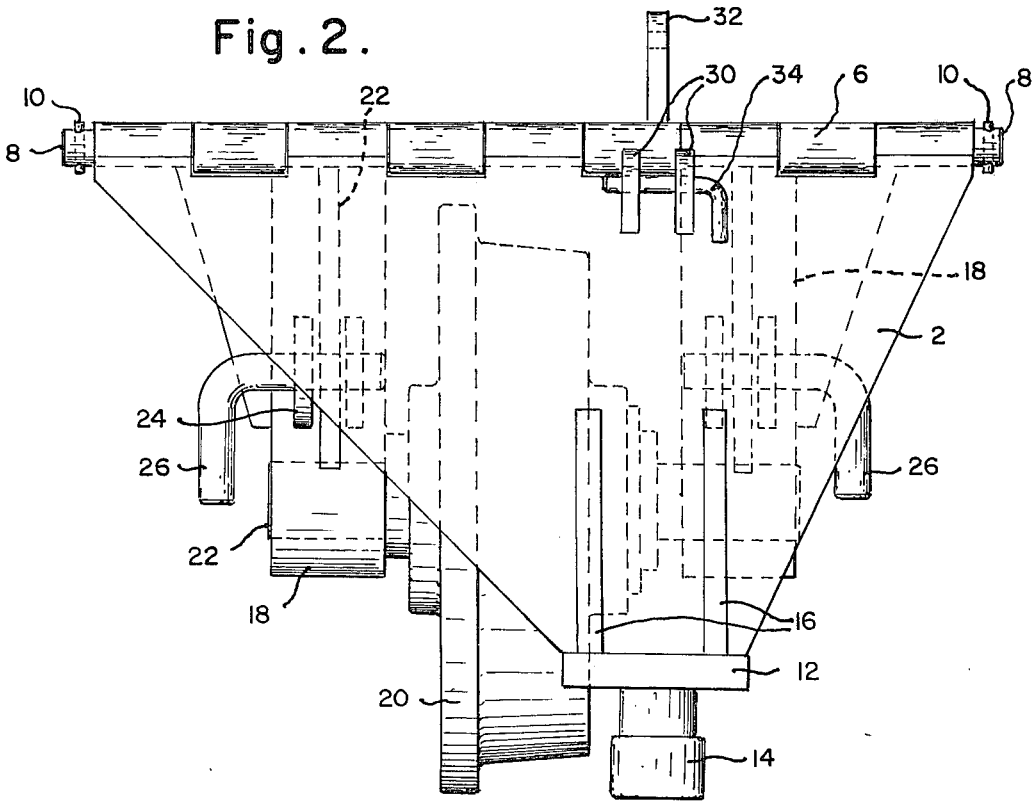
FIG. 2 is an end view of the same embodiment.

Referring to the drawings a leg 2 is pivotably attached to a base 4 by means of a hinge 6 and rod 8 arrangement to form a suspension housing. Holes are drilled at each end of the rod 8 through which pins 10 are inserted to hold the rod in place. A foot 12 is provided at the base of the leg 2 which is welded to the leg 2. A plurality of rollers or cam followers 14 are attached to the foot 12 in a position so that they will ride adjacent to the railroad track when the derail guard is attached to the vehicle and the leg is in an operable position. A brace 16 is provided to support the foot 12. We have chosen the leg, foot and brace arrangement because it can be easily constructed from metal sheets and yet provides the desired strength. However, a one piece leg may be substituted for this design. The derail guard is attached to the vehicle by a pair of struts 18 extending from the base 4 and positioned so they will straddle the vehicle wheel 20 and engage the axle 22 passing through the wheel. Such an arrangement may not be necessary for vehicles having a deck or other member above or near the wheels to which the base 4 can be attached.

In the drawings the derail guard is shown in an operable position being held in place by a first flange 22 extending from the leg 2 and a second flange 24 extending from the base 4. Holes are provided in the flanges which are aligned when the leg is in an operable position. A pin 26 is inserted through the holes to hold the leg in place. A similar arrangement is provided to hold the leg in a rest position. Flanges 30 and 32 are attached to the base and leg. Holes are provided in each flange through which a pin 34 is inserted to retain the leg in a rest position.

While we have shown and described a present preferred embodiment of the invention, it is to be distinctly understood that the invention is not limited thereto but may be otherwise variously embodied within the scope of the following claims.

We claim:

1. A derail guard for rail vehicles of the type having flanged wheels supported on rails with an axle passing therethrough comprising:

a. a suspension housing having a base for attachment to the vehicle and a leg pivotably attached to said base, b. attachment means attaching the base of the housing to a flanged wheel of the vehicle, comprised of a pair of struts sized so that they can engage the axle and attached to the base in a substantially parallel relation to each other and sufficiently far apart so that a flanged wheel will fit between the struts, c. first locking means for securing the leg to the base in an operable position, d. second locking means for securing the leg to the base in a rest position, and e. at least one roller member attached to the leg to engage the rail.

2. The derail guard of claim 1 wherein the leg is comprised of an L-shaped member and a brace attached thereto.

3. The derail guard of claim 1 wherein the first locking means comprises:

a. a first flange attached to the leg and having a hole, b. a second flange attached to the base and having a hole therein, and c. a pin sized to fit the holes of the first and second flanges wherein the flanges are positioned so that their holes are in alignment when the leg is in the rest position.

4. The derail guard of claim 1 wherein the second locking means comprises:

a. a first flange attached to the leg and having a hole therein, b. a second flange attached to the base and having a hole therein, and c. a pin sized to fit the holes of the first and second flanges wherein the flanges are positioned so that their holes are in alignment when the leg is the operable position.

* * * * *